US008348101B2

(12) United States Patent
Ciavarella et al.

(10) Patent No.: US 8,348,101 B2
(45) Date of Patent: Jan. 8, 2013

(54) LOCKING DISPENSER

(75) Inventors: Nick E. Ciavarella, Seven Hills, OH (US); Aaron Ronald Reynolds, North Canton, OH (US)

(73) Assignee: GOJO Industries, Inc., Akron, OH (US)

( * ) Notice: Subject to any disclaimer, the term of this patent is extended or adjusted under 35 U.S.C. 154(b) by 951 days.

(21) Appl. No.: 12/417,109

(22) Filed: Apr. 2, 2009

(65) Prior Publication Data

US 2010/0252568 A1 Oct. 7, 2010

(51) Int. Cl.
*B67B 1/00* (2006.01)

(52) U.S. Cl. ..... 222/153.13; 222/147; 222/181.3; 222/325; 141/383; 340/573.1

(58) Field of Classification Search ..... 222/65, 222/74–75, 92–107, 153.01–153.04, 153.11–153.14, 222/147, 181.1, 182, 185.1, 325–327, 382, 222/383.3, 385, 401; 141/346–347, 367, 141/383–386; 340/540–543, 573.1
See application file for complete search history.

(56) References Cited

U.S. PATENT DOCUMENTS

| | | | | |
|---|---|---|---|---|
| 4,150,673 | A * | 4/1979 | Watt | 604/408 |
| 4,391,309 | A | 7/1983 | Steiner | |
| 4,489,359 | A * | 12/1984 | Suzuki | 361/172 |
| 4,907,019 | A * | 3/1990 | Stephens | 347/86 |
| 5,293,913 | A * | 3/1994 | Preszler | 141/367 |
| 5,312,017 | A | 5/1994 | Schroeder | |
| 5,605,251 | A | 2/1997 | Retti | |
| 5,738,153 | A | 4/1998 | Gerling | |
| 5,832,972 | A * | 11/1998 | Thomas et al. | 141/360 |
| 5,875,921 | A | 3/1999 | Osgar | |
| 6,431,400 | B1 * | 8/2002 | O'Maley et al. | 222/41 |
| 6,619,512 | B1 * | 9/2003 | Sayers et al. | 222/207 |
| 7,028,861 | B2 | 4/2006 | Sayers | |
| 7,066,357 | B2 * | 6/2006 | Ciavarella et al. | 222/156 |
| 7,837,066 | B2 * | 11/2010 | Reynolds et al. | 222/52 |
| 7,980,421 | B2 * | 7/2011 | Ophardt et al. | 222/1 |
| 2006/0124662 | A1 * | 6/2006 | Reynolds et al. | 222/23 |
| 2008/0283556 | A1 * | 11/2008 | Snodgrass | 222/325 |
| 2009/0236440 | A1 | 9/2009 | Anderson | |

FOREIGN PATENT DOCUMENTS

WO WO 03/033398 A1 4/2003

OTHER PUBLICATIONS

ISA/EPO, International Search Report, Apr. 30, 2010.

* cited by examiner

*Primary Examiner* — Kevin P Shaver
*Assistant Examiner* — Andrew P Bainbridge
(74) *Attorney, Agent, or Firm* — Renner, Kenner, Greive, Bobak, Taylor & Weber

(57) ABSTRACT

A locking dispenser to dispense material from a replaceable refill container maintains a lock assembly having a plurality of spring-biased plungers configured in accordance with a predetermined lock parameter. The refill container carries a collar that includes a plurality of markers configured in accordance with a predetermined key parameter. Thus, when a refill container having a key parameter that is compatible with the lock parameter of the key block is installed at the dispenser, the plungers transition from a locked state to an unlocked state to enable the movement of an actuator, which when depressed by a user, results in the dispensement of material from the refill container.

33 Claims, 16 Drawing Sheets

LOCKING DISPENSER

TECHNICAL FIELD

Generally, the present invention relates to dispensers and associated refill containers. In particular, the present invention relates to dispensers that are configured to prevent the use of unauthorized refill containers. More particularly, the present invention is directed to a locking dispenser that is transitioned from a disabled, locked state to an enabled, unlocked state when a refill container with a valid key parameter is inserted therein.

BACKGROUND ART

Dispensers provide a convenient and sanitary source of various materials that are maintained within a replaceable refill container. For example, depending on the needs of the entity using the dispenser, the dispenser may be filled with a refill container maintaining soap, moisturizer, disinfectant, or other material. As such, dispensers utilizing replaceable refill containers provide a virtually continuous supply of dispensing material, while allowing a variety or range of materials to be interchangeably dispensed as needed.

However, the ability of a single dispenser to dispense a variety of products contained in various refill containers can lead to harm in the event that one product is inadvertently substituted for another. Furthermore, in circumstances where the health and safety of individuals is reliant on the correct material being dispensed, it is imperative that the correct refill container be consistently placed in the dispenser. For example, in the case of hospitals, surgeons and their support staff may require antimicrobial soap to cleanse their hands prior to performing surgery. In the event that the antimicrobial soap is inadvertently replaced with non-antimicrobial soap, the patient being treated thereby may be exposed to bacteria that could lead to a harmful or lethal infection. Aside from inadvertent refill substitutions, it is also a concern that individuals may undertake targeted efforts to knowingly substitute one refill container having one type of material for another refill container having another type of material to exact injury or death to another individual. It is yet a further concern that the product provided for use in the dispenser is manufactured or supplied by a certain predetermined entity to ensure quality and product compatibility with the dispenser, in addition to other concerns.

To resolve these concerns, efforts have been directed to providing a dispenser designed with locking or securing mechanisms that affect the positioning or fit of a refill container within the housing of the dispenser, thereby restricting placement of the refill containers within the dispenser to only those containers that contain the proper "key" to overcome the lock. For example, it is known in the art to use a mechanical key within the dispenser, such that the mechanical structure of the dispenser allows placement of only replacement containers that have a corresponding or complementary mechanical structure that fit within the mechanical structure of the dispenser. Unfortunately, mechanical keys and other locking devices used by dispensers to restrict the placement of unauthorized refill containers therein are generally exposed when the dispenser is opened and are relatively simple to defeat or circumvent by minimally-trained individuals.

Additionally, such locking devices utilize mechanical components formed of metal that are susceptible to corrosion when the dispenser is exposed to moisture present in its operating environment. Thus, because such dispensers are generally placed in and about regions of moisture, such as about showers, sinks, and the like, it is generally only a matter of time before such locking devices become unreliable or fail completely. Although electronic keys may overcome some of the disadvantages of locking devices that use metal components, they tend to be substantially more expensive and are similarly susceptible to damage in moist environments.

Moreover, it is common practice for distributors of refill containers to furnish the dispenser to an institution, such as a hospital, for free or reduced cost in exchange for the exclusive right to provide replacement refill containers for the dispenser throughout its operating life or some portion thereof. Such agreements are provided to ensure that unauthorized replacement refill containers, which may be of inferior quality, are not surreptitiously used in the dispenser and also to protect the distributor's sales of authorized replacement refill containers from being overtaken by competitors. Unfortunately, however, such exclusive agreements are difficult to enforce without an effective mechanism in which to prevent the unauthorized substitution of replacement refill containers.

Therefore, there is a need for a dispenser with a locking device that is made operational when a compatible refill container is inserted therein. Additionally, there is a need for a dispenser that provides a locking system that is inexpensive to deploy. Furthermore, there is a need for a dispenser with a locking device that is resistant to corrosion when the dispenser is installed in regions where moisture is present.

SUMMARY OF INVENTION

In light of the foregoing, it is a first aspect of the present invention to provide a locking dispenser comprising a refill container carrying material therein to be dispensed by a pump coupled thereto, said refill container having a collar maintaining at least one marker configured in accordance with a predetermined key parameter; a support bracket adapted to carry said refill container; a lock assembly attached to said support bracket configured to be interfaced with said collar, said lock assembly maintaining at least one movable plunger configured in accordance with a predetermined lock parameter; and an engagement bar operatively coupled to said support bracket that when actuated engages said pump to dispense said material from said refill container, said engagement bar maintaining a lock arm in operative communication with said at least one plunger, said plunger initially locking said lock arm to prevent the actuation of said engagement bar; wherein said plunger unlocks said lock arm to enable the actuation of said engagement bar if said key parameter of said at least one marker is authorized by said lock parameter of said plunger when said marker and said plunger are interfaced, so as to enable the dispensing of said material from said refill container when said engagement bar is actuated.

It is another aspect of the present invention to provide a method for operating a locking dispenser comprising providing a dispenser maintaining at least one movable plunger configured in accordance with a lock parameter, said plunger operatively engaging said dispenser to place said dispenser in a normally locked state; providing a refill container carrying material to be dispensed having at least one marker configured in accordance with a key parameter; installing said refill container at said dispenser, such that said marker is interfaced with said plunger; and unlocking said dispenser if said key parameter of said marker is authorized by said lock characteristic of said plunger.

BRIEF DESCRIPTION OF THE DRAWINGS

These and other features and advantages of the present invention will become better understood with regard to the following description, appended claims, and accompanying drawings wherein:

BEST MODE FOR CARRYING OUT THE INVENTION

Figure 1:
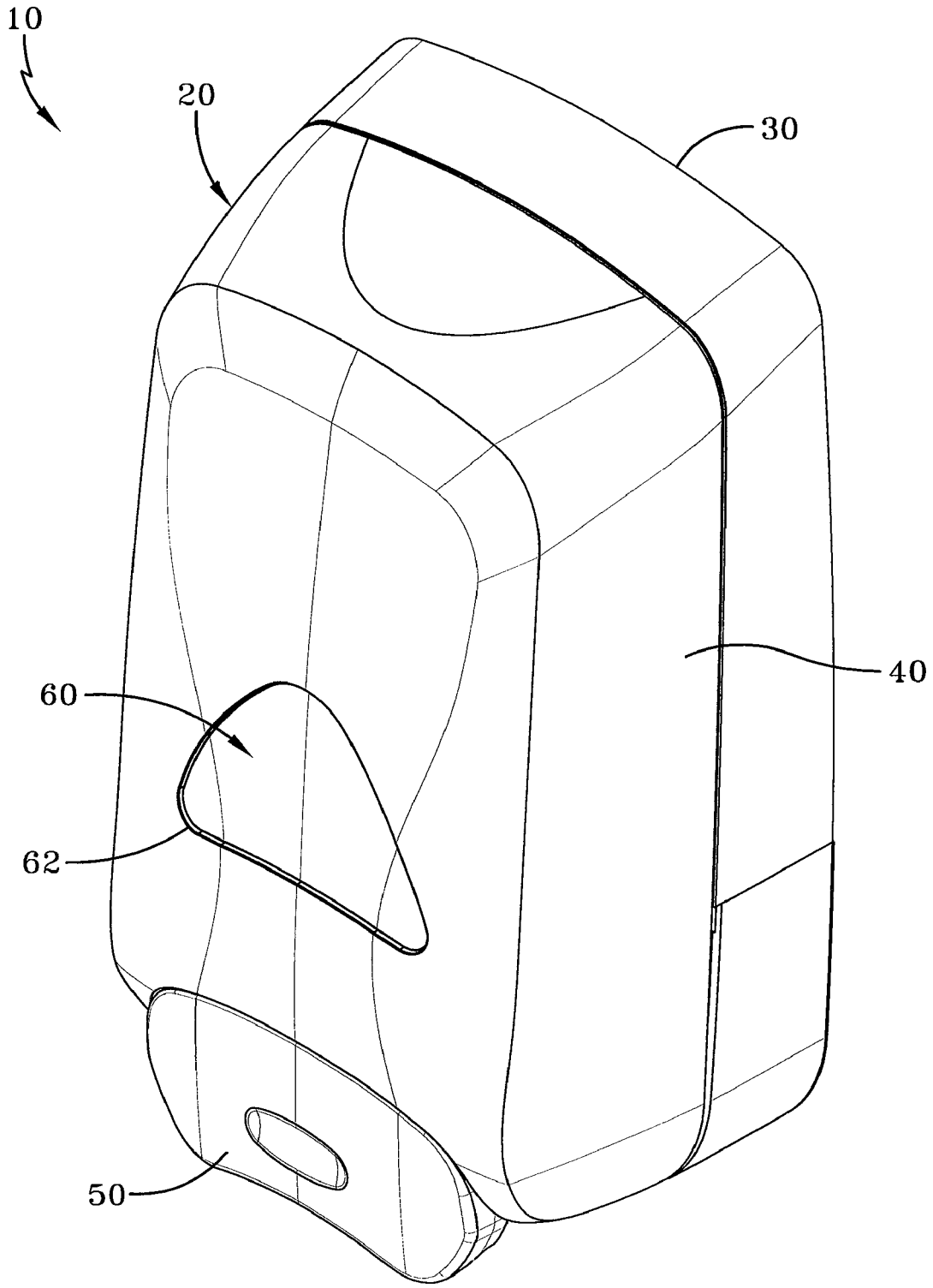
FIG. 1 is a front perspective view of a locking dispenser in accordance with the concepts of the present invention.
Figure 2:
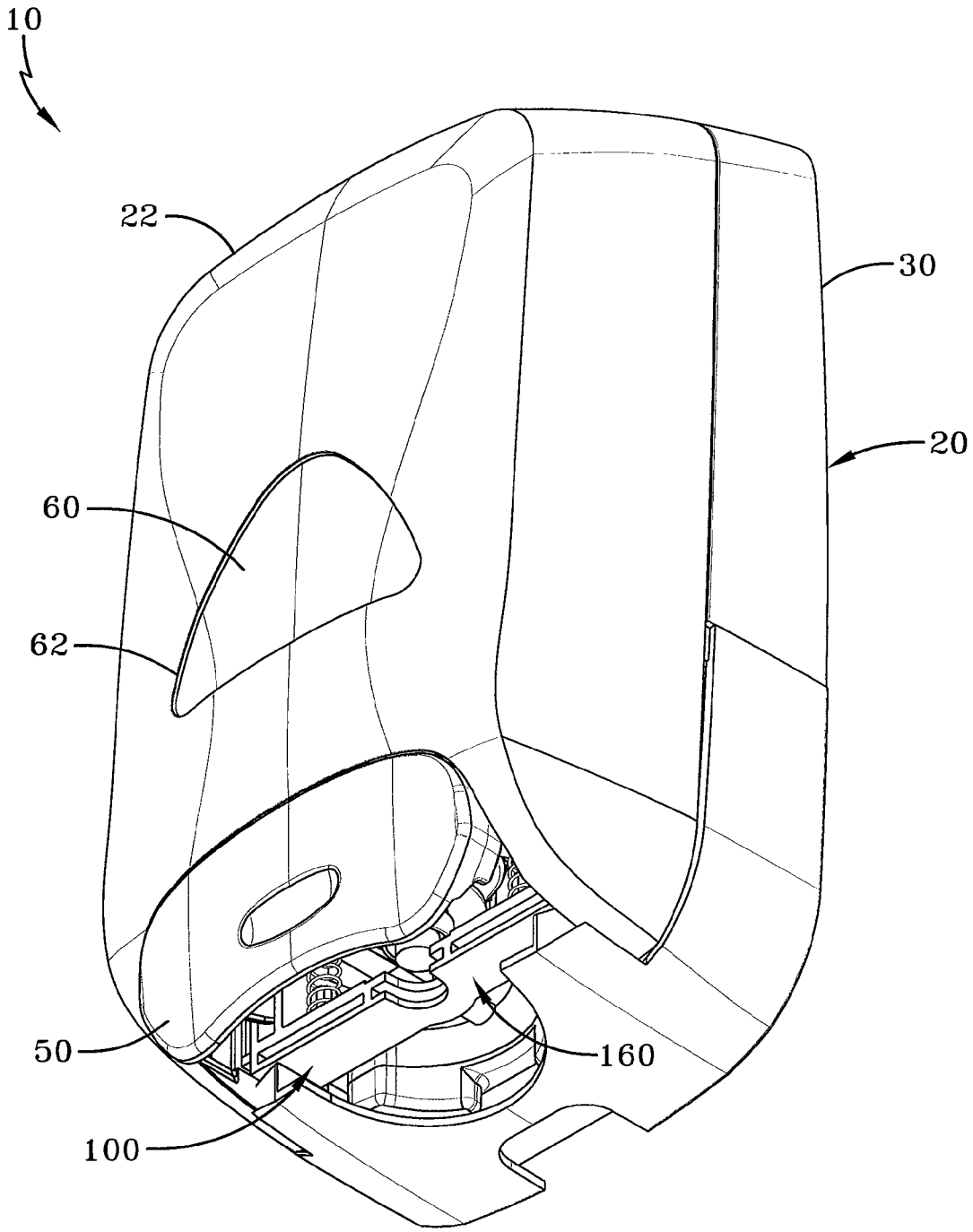
FIG. 2 is a bottom perspective view of the locking dispenser in accordance with the concepts of the present invention.

An exemplary locking dispenser of one aspect of this invention is generally referred to by the numeral 10, as shown in FIG. 1 of the drawings. The dispenser 10, such as a soap dispenser, includes a housing 20 that provides a back plate 30 that is mounted or otherwise secured to a wall, column, or other suitable surface or structure. A removable front cover 40 is coupled to the back plate 30, which may be opened to allow access to the components contained within the dispenser housing 20. The dispenser 10 also includes an actuator 50 that when depressed results in the dispensing of material from a refill container 60 carried within the dispenser housing 20. For example, the refill container 60 may include any liquid material, including, but not limited to, soap, moisturizer, and disinfectant. In addition, the front cover 40 of the dispenser 10 optionally includes a window 62, which allows a user to view the remaining contents of the refill container 60.

In order to prevent unauthorized refill containers from being used in the dispenser 10, compatible refill containers 60 maintain a predetermined key parameter, which is interfaced with a predetermined lock parameter maintained by the dispenser 10 when the refill container 60 is installed thereto. Thus, at the time of manufacture of the refill container 60 and the dispenser 10, lock and key parameters are selected so that they are either compatible or non-compatible with each other. As such, a refill container 60 with a key parameter that is incompatible with the lock parameter of the dispenser 10 will not be authorized and thereby causes the dispenser 10 to remain in a normally locked state when inserted therein, thereby preventing any actuation of the actuator 50 to dispense material from the refill container 60, thus leaving the dispenser 10 in a disabled state. Alternatively, when a refill container 60 with a key parameter that is compatible with the lock parameter of the dispenser 10 is inserted therein, it is authorized, thereby causing the dispenser 10 to transition from a normally locked state to an unlocked state, thus enabling the dispenser 10 to operate and allowing the actuator 50 to be depressed to initiate the dispensing of material from the refill container 60.

Figure 6:
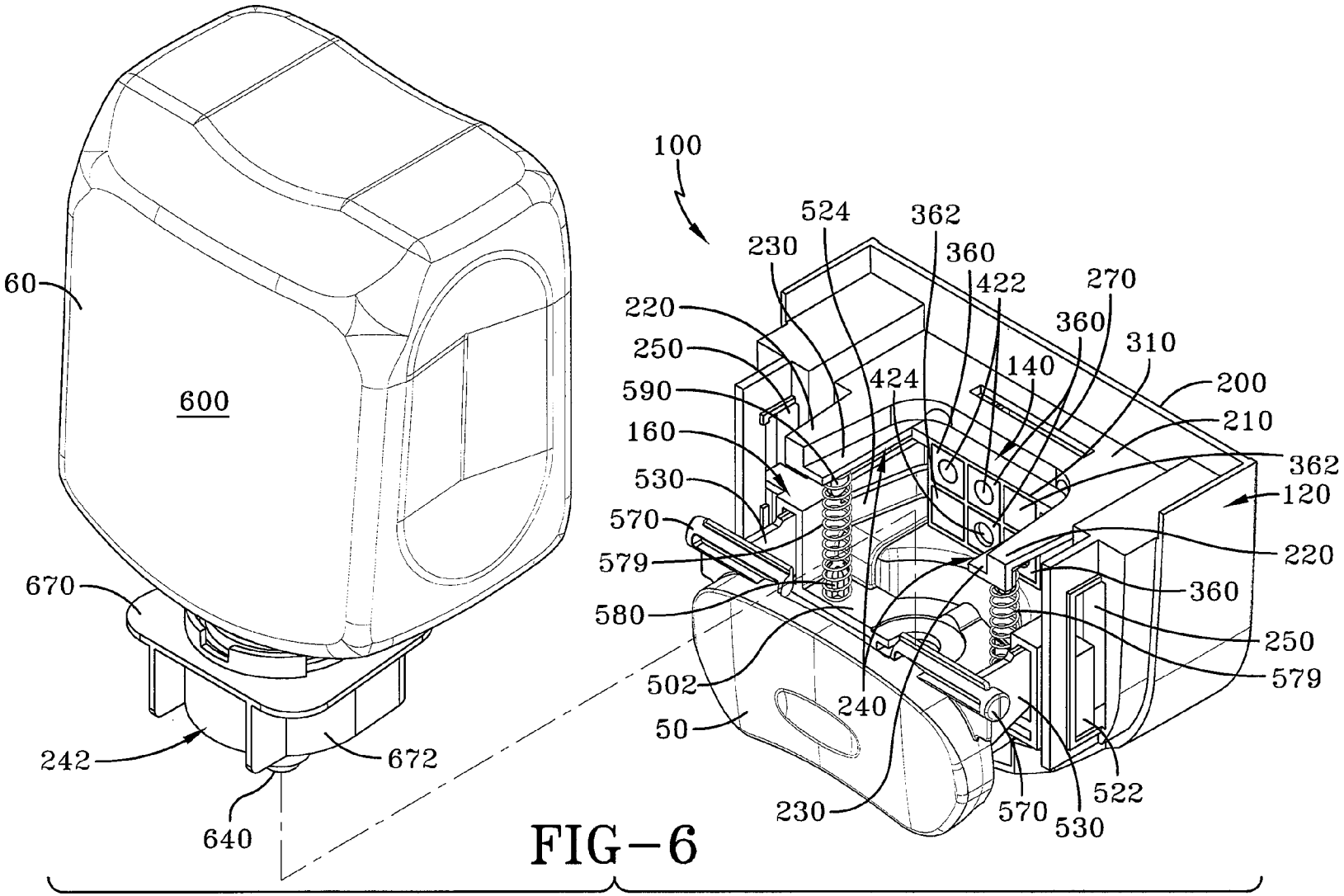
FIG. 6 is another perspective view of the refill carrier assembly when the refill container is removed therefrom in accordance with the concepts of the present invention.
Figure 7:
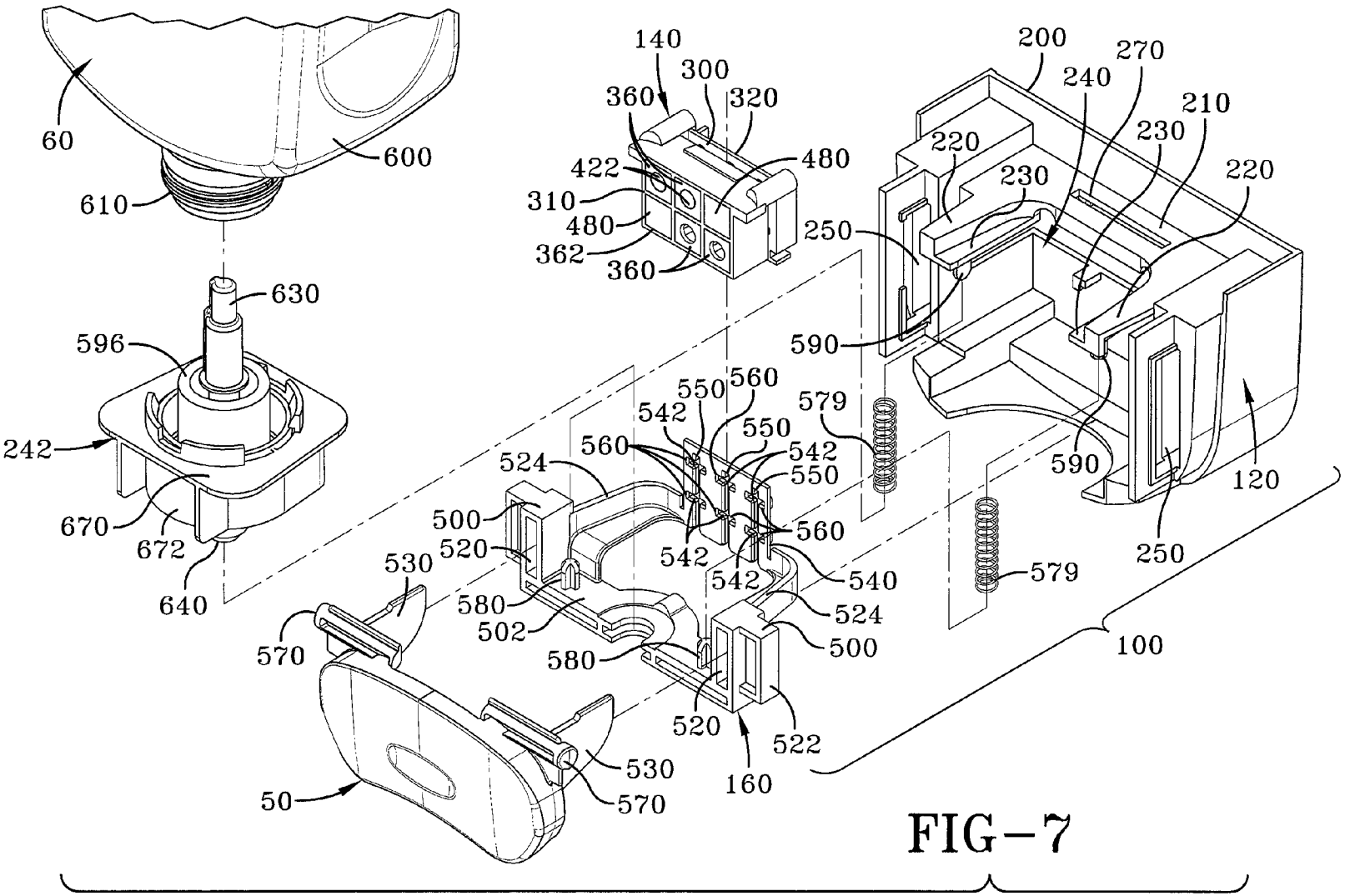
FIG. 7 is an exploded view of the refill carrier assembly and the components of the locking dispenser in accordance with the concepts of the present invention.

With reference now to FIGS. 2-7, the dispenser 10 includes a refill carrier assembly 100 disposed within the housing 20 of the dispenser 10, which serves to support the refill container 60 and several of the other components of the locking dispenser 10. Specifically, as shown in FIGS. 6 and 7, the refill carrier assembly 100 includes a support bracket 120, a lock assembly 140, and an engagement bar 160 that co-act to enable the locking features of the dispenser 10. In particular, the support bracket 120 includes a bracket back plate 200 and a support section 210, which extends from the bracket back plate 200 at a substantially right angle. In addition, a pair of support arms 220 extend from the bracket back plate 200 at a substantially right angle, while a pair of support ledges 230 extend laterally inward from the support arms 220 to form a collar receiver 240 that is configured to retain and support a collar 242 that is maintained by the refill container 60. A pair of vertically-oriented guide slots 250 that extend at a substantially right angle from the bracket back plate 200 are disposed to the outside of each support arm 220. Furthermore, a receiving slot 270 is disposed within the support section 210 to permit a portion of the engagement bar 160 to move therethrough in a manner to be discussed. It should also be appreciated that the refill carrier assembly 100 may be formed from any suitable material, such as plastic for example.

Figure 8:
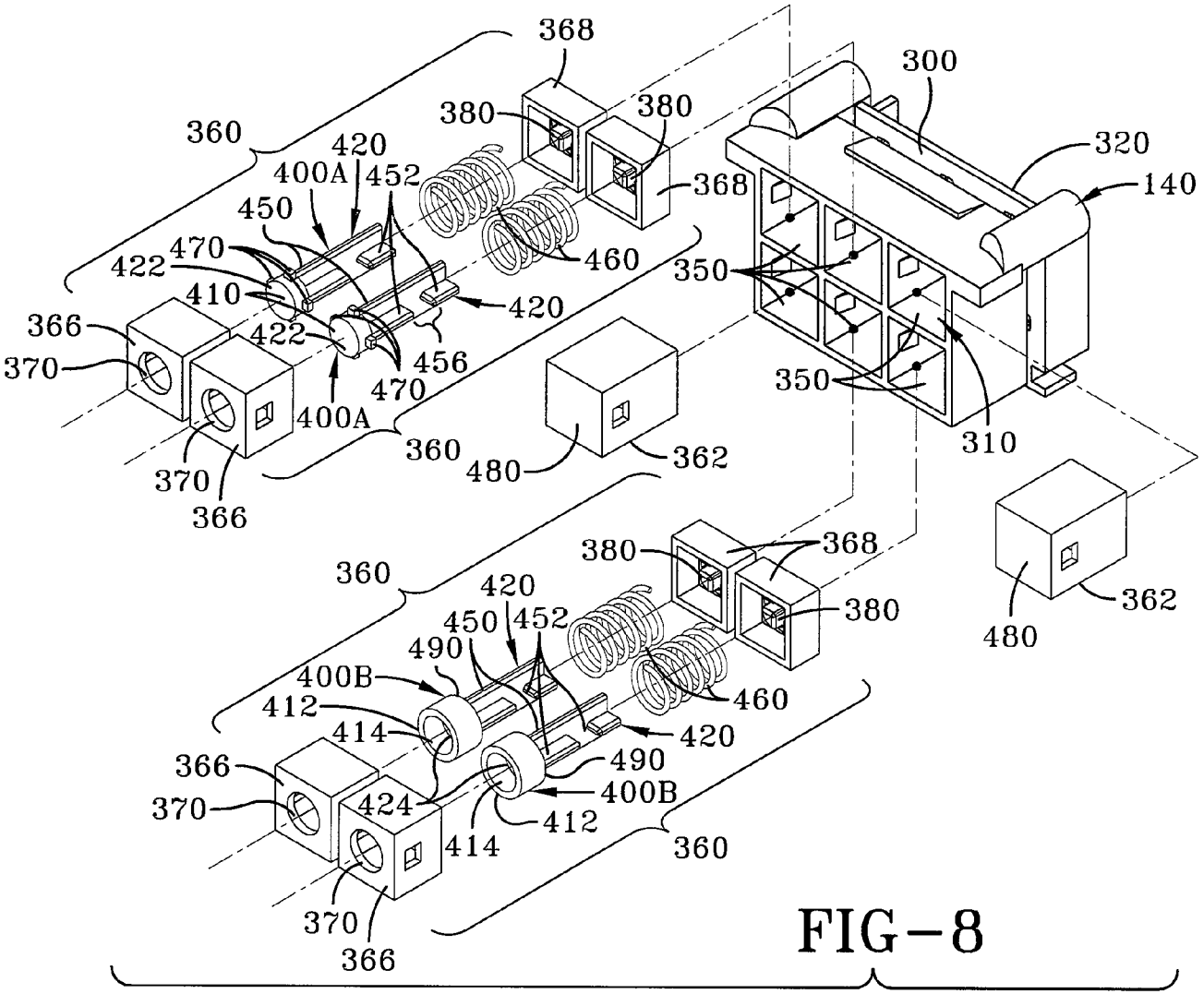
FIG. 8 is an exploded view of a lock assembly maintained by the refill carrier assembly and associated plunger blocks and dead blocks disposed therein in accordance with the concepts of the present invention.
Figure 11:
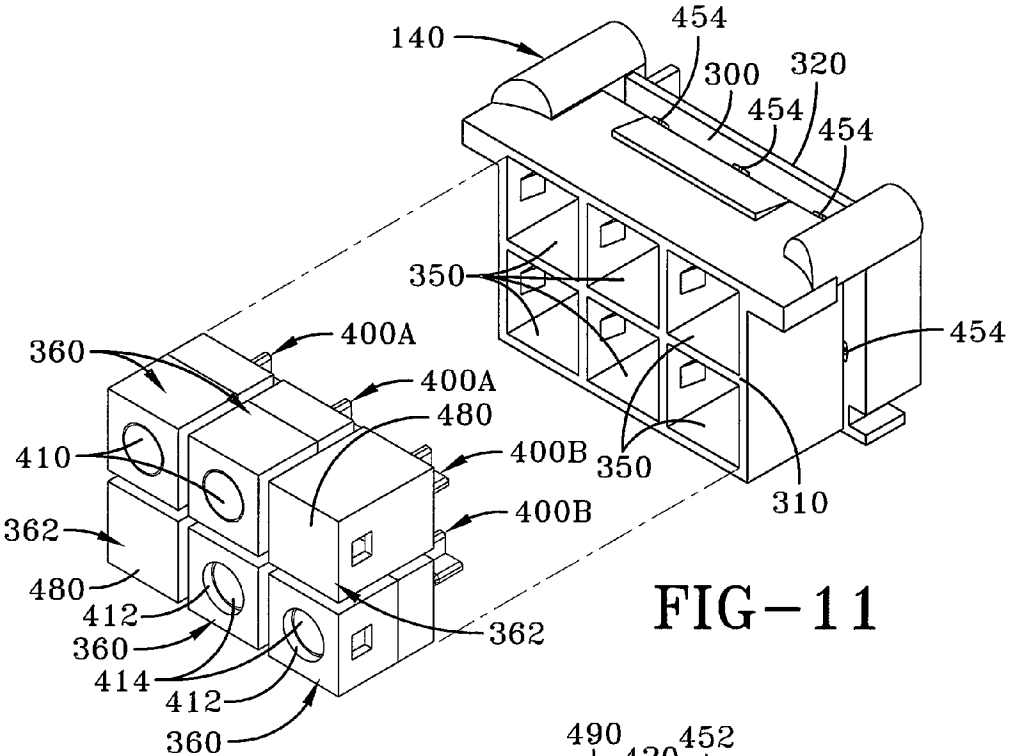
FIG. 11 is another perspective view of the lock assembly showing the manner in which the plunger blocks and dead blocks are disposed therein in accordance with the concepts of the present invention.

The lock assembly 140 includes a lock slot 300 that separates a lock grid 310 from a lock plate 320 and is attached to the support bracket 120, such that the lock slot 300 is aligned with the receiving slot 270 maintained by the support section 210 of the support bracket 120. In particular, the lock assembly 140 may be attached to the support bracket 120 using any suitable fastener or adhesive. The lock grid 310, shown clearly in FIG. 8, provides a plurality of retainer apertures 350 that are dimensioned to receive any desired combination of plunger blocks 360 and dead blocks 362 therewithin, as shown in FIGS. 8-11. In one aspect, the plunger blocks 360 and the dead blocks 362 may be retained within the retainer apertures 350 using any suitable means of fixation, including friction fit, snap fit, adhesive, or the like. It should also be appreciated that while six retainer apertures 350 are shown, the lock grid 310 may be configured with any number of suitable retainer apertures 350, which may be arranged in any suitable pattern or geometric configuration, such as a rectangular or triangular arrangement. In addition, the retainer apertures 350 may be configured to take on any suitable shape or dimension that is compatible with the shape associated with the plunger blocks 360 and dead blocks 362, which may also take on any suitable shape or dimension.

The plunger blocks 360, as shown in FIGS. 8-11, comprise an outer section 366 and an inner section 368 that are fastened together using any suitable means of fixation, such as adhesive for example. The outer section 366 maintains an engagement aperture 370 that is opposite a block aperture 380 maintained by the inner section 368. Disposed within the plunger blocks 360 are various plungers 400A and 400B, which respectively comprise a flat head 410 and a recessed head 412 having an aperture 414 disposed therein, from each of which extends at a substantially right angle a keyed extension 420. In one aspect, the flat head 410 and the recessed head 412 may contain any suitable material, including steel, as well as magnetic material, which may be enclosed in plastic, rubber, or any other suitable material. In addition, the magnetic material may be arranged such that its N (north) and S (south) poles of each of the heads 410,412 are oriented adjacent to or distal from a contact surface 422,424 maintained by respective heads 410,412.

Figure 12:
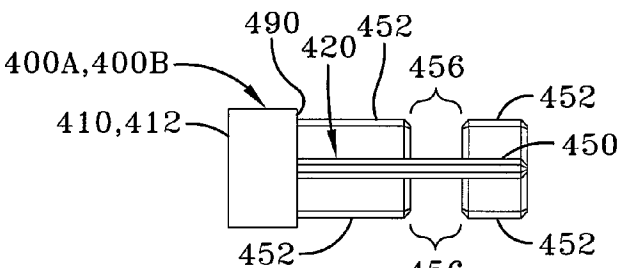
FIG. 12 is a top plan view of the plungers shown in FIGS. 9 and 10 showing a keyed extension that includes lock sections, slide sections, and notched sections in accordance with the concepts of the present invention.
Figure 9:
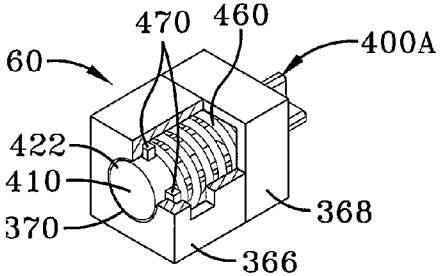
FIG. 9 is a perspective view of the plunger block that is configured to be disposed within the lock assembly in accordance with the concepts of the present invention.
Figure 10:
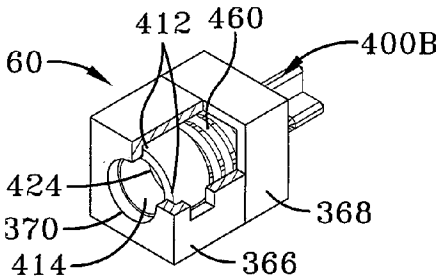
FIG. 10 is a perspective view of an alternative plunger block that is configured to be disposed within the lock assembly in accordance with the concepts of the present invention.

As shown in FIG. 12, the keyed extension 420 of the plungers 400A and 400B is formed from the intersection of a slide section 450 and a lock section 452 that are shaped and dimensioned to be received through the complementary-shaped block apertures 380 disposed within the inner section 368 of the plunger blocks 360, as well as complementary-shaped lock plate apertures 454 disposed within the lock plate 320 that are axially aligned with the block apertures 380. In one aspect, the slide section 450 and the lock section 452 may be arranged as a "cross," whereby the slide section 450 intersects the lock section 452 at a substantially right angle, such that the slide section 450 is substantially vertically oriented and the lock section 452 is substantially horizontally oriented. To enable the operation of the locking dispenser 10, the substantially horizontal lock section 452 is configured to include one or more notched sections 456 located at any desired point along its length. As such, the locked and notched sections 452,456 of the keyed extension 420 selectively enable the dispenser 10 to be placed into either a locked state or an unlocked state, depending on their position, in a manner that will be discussed below. Additionally, while the slide and lock sections 450,452 of the keyed extension 420 may comprise a "cross" configuration, as discussed above, the keyed extension 420 may be configured to have any other suitable shape or dimension, such as curvilinear shape, rectilinear shape, or a combination of both, as long as the shape defined by the slide and lock sections 450,452 maintains a notched section 456 that enables the slide section 450 to extend between one or more lock sections 452, while preventing the slide section 450 from rotating about its central axis when the plungers 400 are engaged during the use of the dispenser 10 in the manner discussed herein.

Continuing, the plunger blocks 360 include a spring 460 that is dimensioned to receive the keyed extension 420 of the plungers 400A and 400B. In the case of plunger 400A, the spring 460 is retained between a plurality of tabs 470 extending from the plunger head 410 and the inner section 368 of the plunger block 360, while in the case of plunger 400B, the spring 460 is retained between a back edge 490 defined by the head 412 and the inner section 368 of the plunger block 360. The spring 460 serves to positively bias the plungers 400A-B, such that the respective contact surfaces 422,424 maintained by the plungers 400A-B are normally urged or biased toward the engagement aperture 370 of the plunger block 360 when no external force is applied to their heads 410,412. Furthermore, due to the relative dimension of the engagement aperture 370 and the heads 410,412 of the plungers 400A-B, the plungers 400A-B are retained within the plunger block 360.

In addition to the plunger blocks 360, the dead blocks 362 include a substantially flat engagement surface 480 that does not include any plungers 400A-B. As such, the retainer apertures 350 of the lock assembly 140 may be configured with any arrangement of key blocks 360 and dead blocks 362 that is desired.

Thus, the physical arrangement of the plunger blocks 360 and the dead blocks 362 within the lock assembly 140, the size and shape of the engagement apertures 370 of the key blocks 360, as well as the size and shape of the keyed extension 420, including the slide section 450, the lock section 452, and the notched section 456, are selected along with the magnetic orientation (north-south) of the contact surfaces 422,424 of the plunger heads 410,412, and their size and shape to establish the lock parameter that is maintained by the dispenser 10. Thus, the lock parameter establishes the criteria that are to be satisfied by the key parameter maintained by the refill container 60 in order to enable operation of the dispenser 10, which will be discussed in more detail below. As such, the lock parameter and key parameter enables individual or groups of dispensers 10 to be configured with different lock parameters in order to facilitate the administration and control over the distribution and use of specific refill containers 60 used in the dispensers 10. Such operation therefore enables the manufacturer or entity providing the dispenser 10 to prevent unauthorized refill containers that lack the necessary key parameter from being used in the dispenser 10. Moreover, refill containers 60 maintaining various materials may be associated with different key parameters so that specific materials are prevented from being dispensed from a given dispenser 10. For example, a group of refill containers 60 that carries soap may have one key parameter that is different from a group of refill containers 60 that carries moisturizer. As such, a dispenser 10 that is configured with a lock parameter that is compatible with the key parameter of the soap-carrying refill container 60 will be prevented from dispensing refill containers that carry moisturizer.

Returning to FIG. 7, the engagement bar 160 is operatively coupled to the support bracket 120 and maintains a pair of legs 500 that extend vertically at a substantially right angle from each end of a lateral member 502. The legs 500 each maintain vertical recesses 520 and guides 522 that extend laterally therefrom. The vertical recesses 520 are configured to receive arms 530 that extend from the actuator 50 so as to be operatively coupled therewith. Additionally, a pair of guides 522 extending from the legs 500 at a substantially right angle are received within corresponding guide slots 250 maintained by the support bracket 120, as shown in FIGS. 4-7. Offset from the lateral member 502 by a pair of support arms 524 is a lock arm 540 that maintains locking apertures 542 disposed therethrough. The locking apertures 542 are comprised of a vertically-oriented slide slot 550 that intersects a horizontally-oriented lock slot 560 at a substantially right angle, which form the locking apertures 542 as a "cross" shaped aperture that is complementary to the "cross" shape of the keyed extension 420 maintained by the plungers 400A-B. The slide slot 550 extends throughout at least a part of the vertical dimension of the lock arm 540 and vertically connects each of the locking apertures 542 together, as shown clearly in FIGS. 7 and 15A-B. As such, locking apertures 542 allow the plungers 400A-B, via the keyed extension 420, to selectively lock and unlock the engagement bar 160 with respect to the lock assembly 140 in a manner to be discussed.

Specifically, the engagement bar 160 operatively communicates with the lock assembly 140 and the support bracket 120 via the lock arm 540 that is received within the lock slot 300 of the lock assembly 140. The lock arm 540 is oriented so as to be substantially parallel with the lock plate 320 maintained by the lock assembly 140, thereby allowing the engagement bar 160 to freely slide up and down through the lock slot 300 and the receiving slot 270.

Figure 15B:
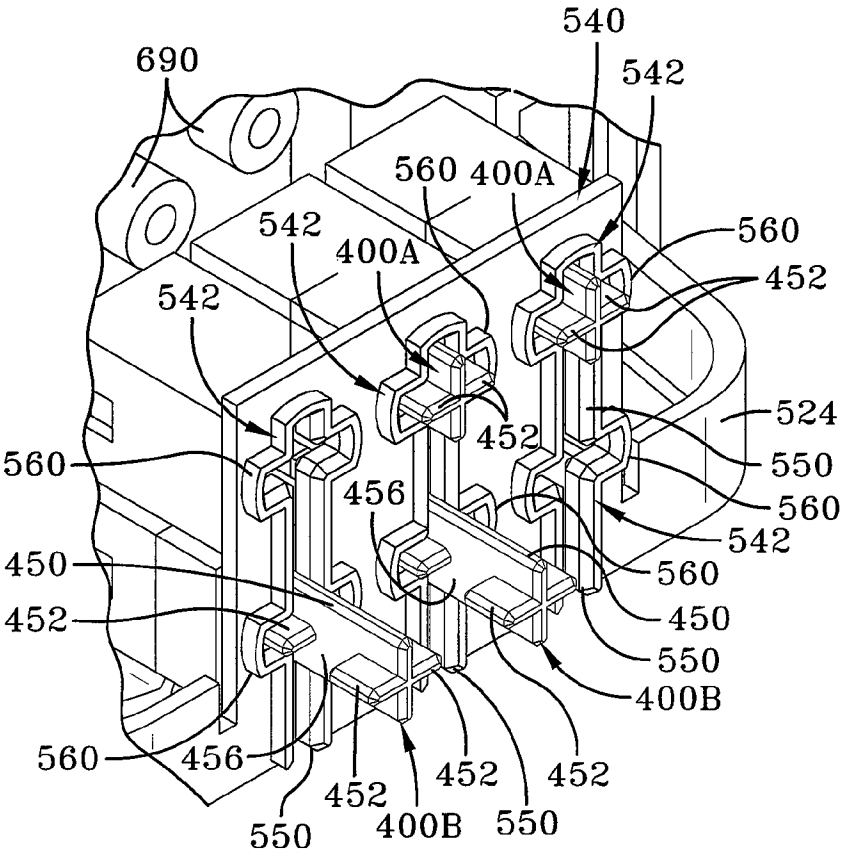
FIG. 15B is another perspective view of the lock arm shown in 15A, whereby the lock sections of the keyed extension are received within respective lock slots maintained by locking apertures disposed in the lock arm in accordance with the concepts of the present invention.
Figure 15A:
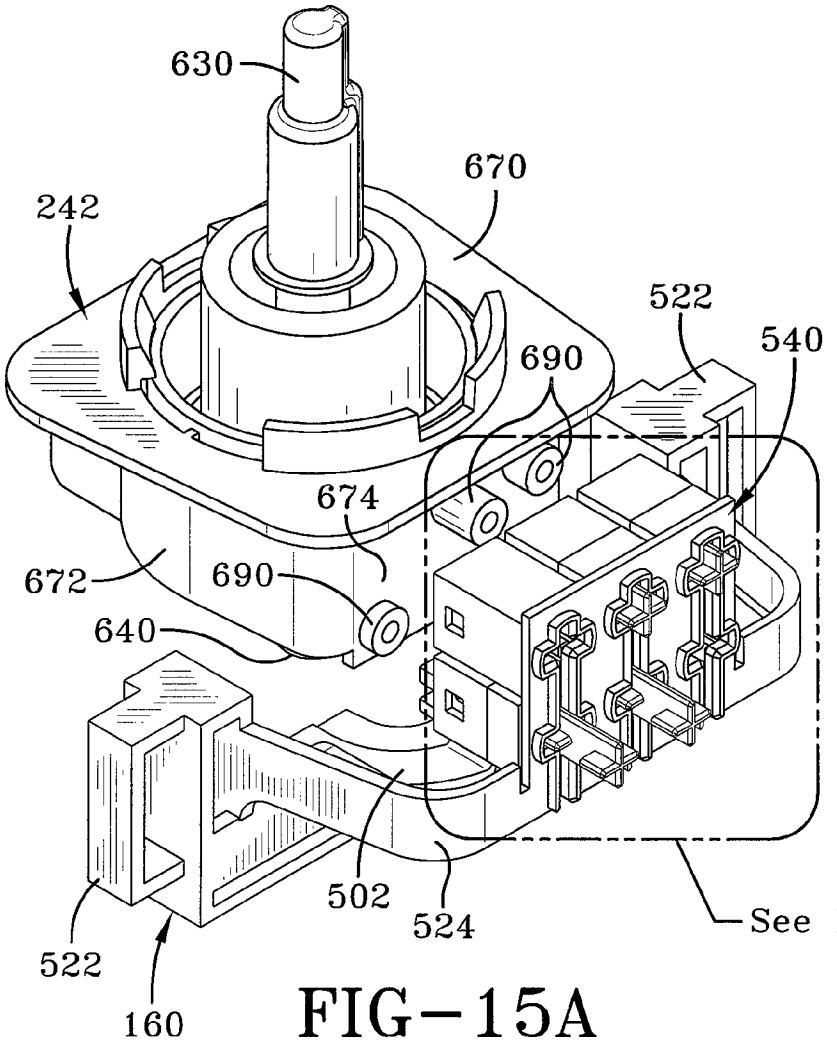
FIG. 15A is a perspective view showing the engagement arm in a normally locked state in accordance with the concepts of the present invention.

When the refill carrier assembly 100 is assembled, the lock arm 540 is received within the lock slot 300, such that the locking apertures 542 of the lock arm 540 are aligned with the block apertures 380 of the plunger blocks 360 and the lock plate apertures 454 of the lock plate 320. Once aligned, the dead blocks 362 and the plunger blocks 360 are installed into the lock assembly 140, and the keyed extension 420 of each of the plungers 400A-B carried by the plunger blocks 360 is disposed through the block apertures 380 of the plunger blocks 360, through the locking apertures 542 of the lock arm 540, and through the lock plate apertures 454 of the lock plate 320. Once installed, the plungers 400A-B are oriented in their initially locked state, such that the lock section 452 of the keyed extension 420 is within the lock slot 560 of the locking apertures 542 of the lock arm 540. That is, due to the normal position of the plungers 400A-B, the engagement bar 160 is normally placed in a locked state, whereby it is not permitted to move upward relative to the lock assembly 140, as shown in FIGS. 15A-B. Moreover, the lock plate apertures 454 assist in the support of the keyed extension 420, allowing the plungers 400A-B to smoothly translate or move inward and outward as they are biased by the collar 242 in a manner to be discussed.

Figure 3:
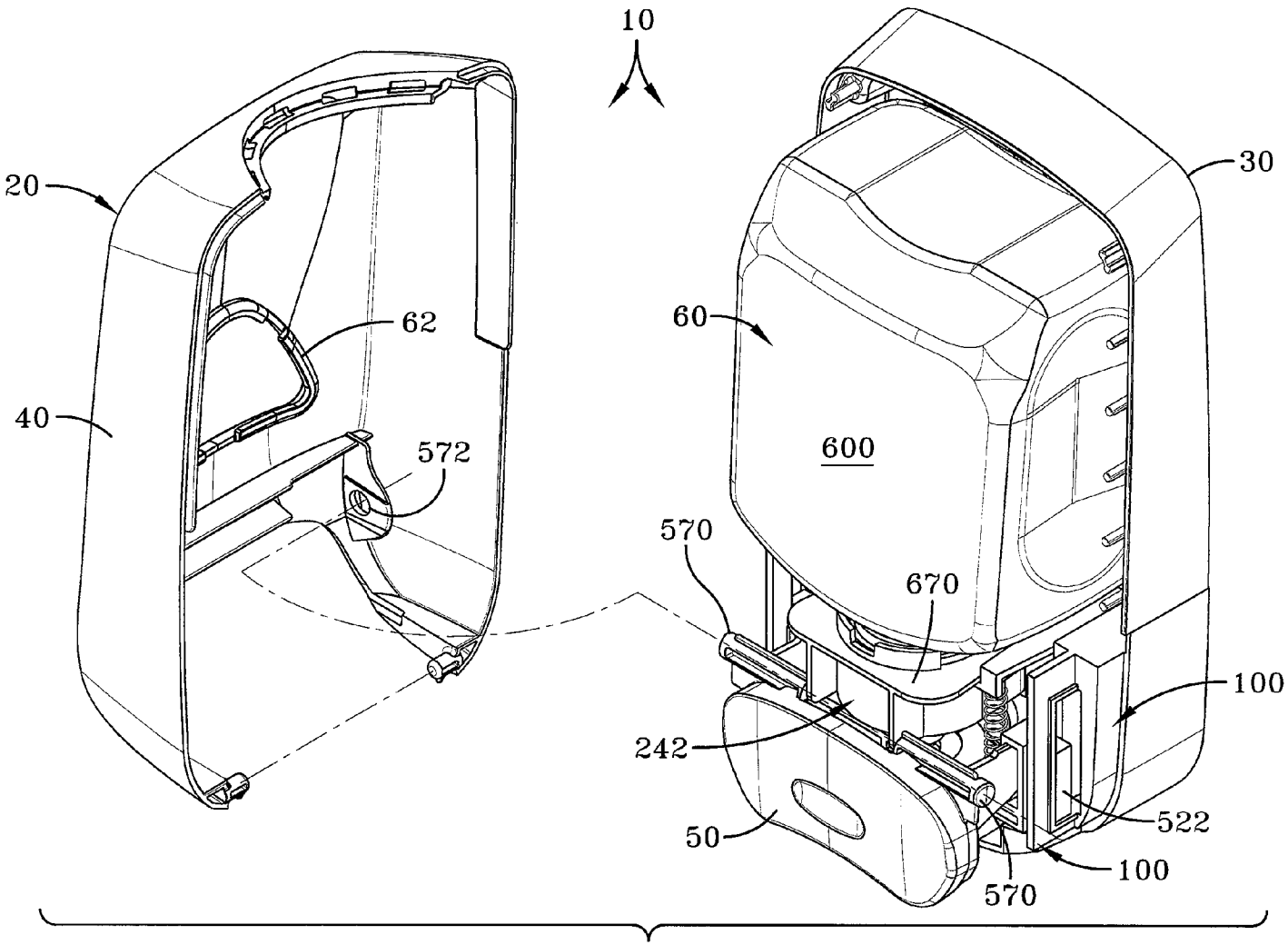
FIG. 3 is a perspective view of the of the locking dispenser with its cover removed to show a refill container inserted therewithin in accordance with the concepts of the present invention.
Figure 4:
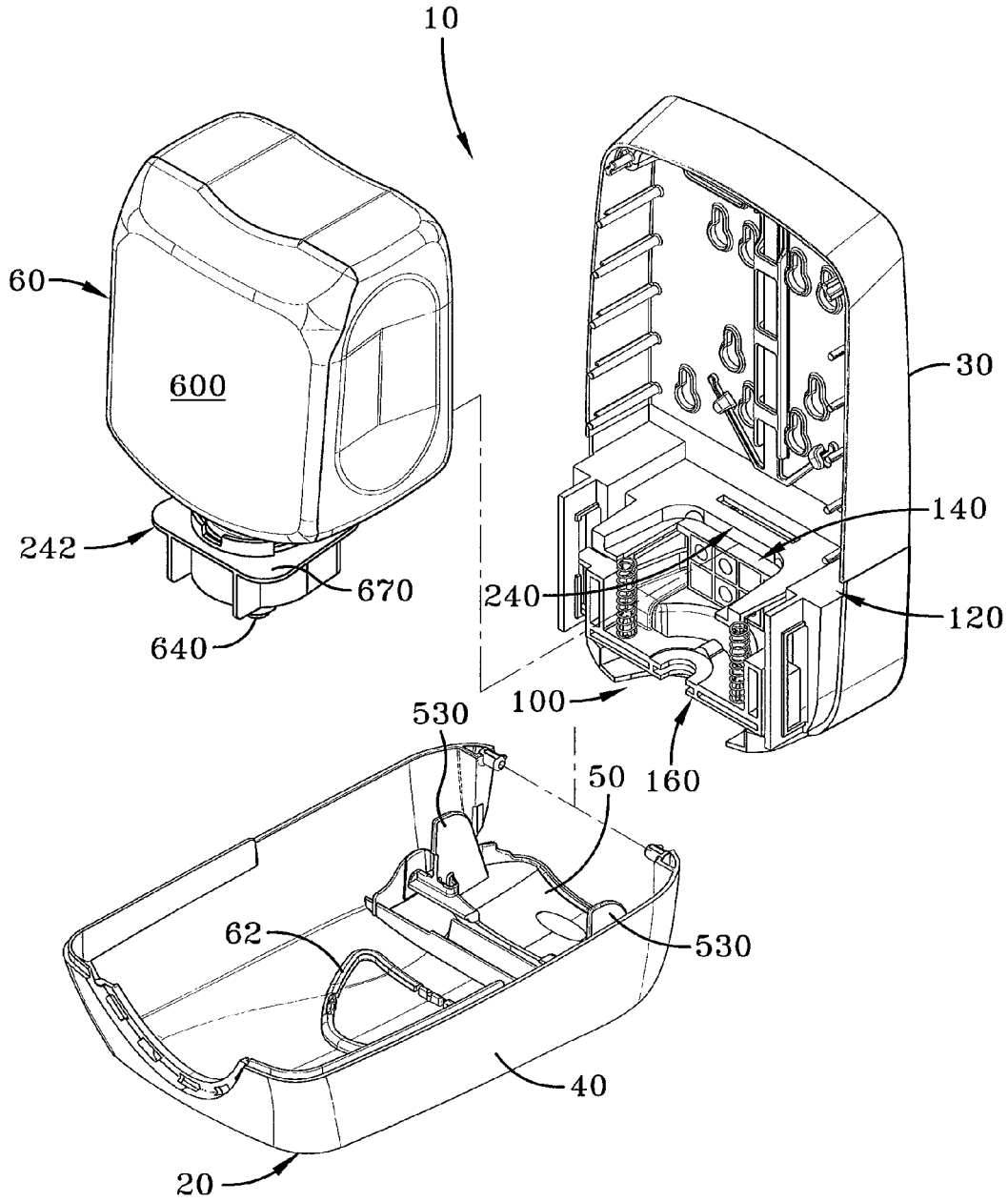
FIG. 4 is an exploded view of the locking dispenser showing the manner in which the refill container is inserted into the locking dispenser in accordance with the concepts of the present invention.
Figure 5:
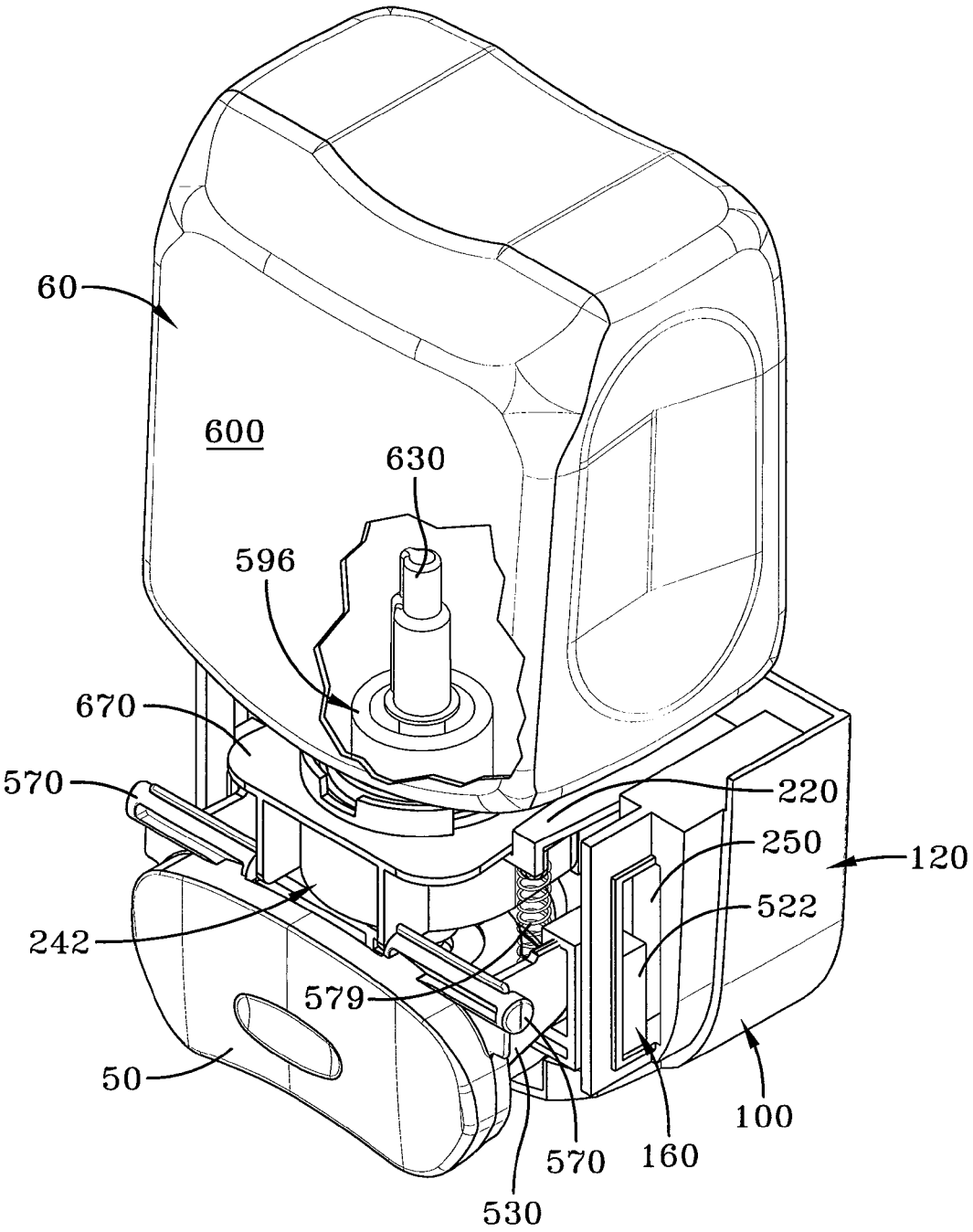
FIG. 5 is a perspective view of the locking dispenser showing a refill carrier assembly maintained thereby in accordance with the concepts of the present invention.

The dispenser 10 also includes the actuator 50, which maintains arms 530 that operatively engage vertical recesses 520 maintained by the engagement bar 160. Additionally, the actuator 50 is rotatably carried via a pair of arms 570 that are received within corresponding apertures 572, one of which is shown in FIG. 3, which are maintained by the cover 40 of the dispenser 10. Thus, during operation of the dispenser 10 when it is in an unlocked state to be discussed, the engagement bar 160 is moved upward from its normal resting state upon the engagement or depression of the actuator 50. To return or bias the engagement bar 160 back to its initial resting position after the actuator 50 has been depressed and the engagement bar 160 has been moved upward, a pair of springs 579 are disposed between retention tabs 580 maintained by the engagement bar 160 and retention tabs 590 maintained by the support arms 220 of the support bracket 120. It should be appreciated that the dispenser 10 may be configured as a hands-free system that does not require a user to physically engage the actuator 50. As such, the actuator 50 may be configured as a hand-detection sensor, such as an IR sensor or biometric sensor, that is configured to detect the presence of a user's hand and thereby actuate the engagement bar 160 to dispense material from the refill container 60 using any suitable motorized means.

Figure 13:
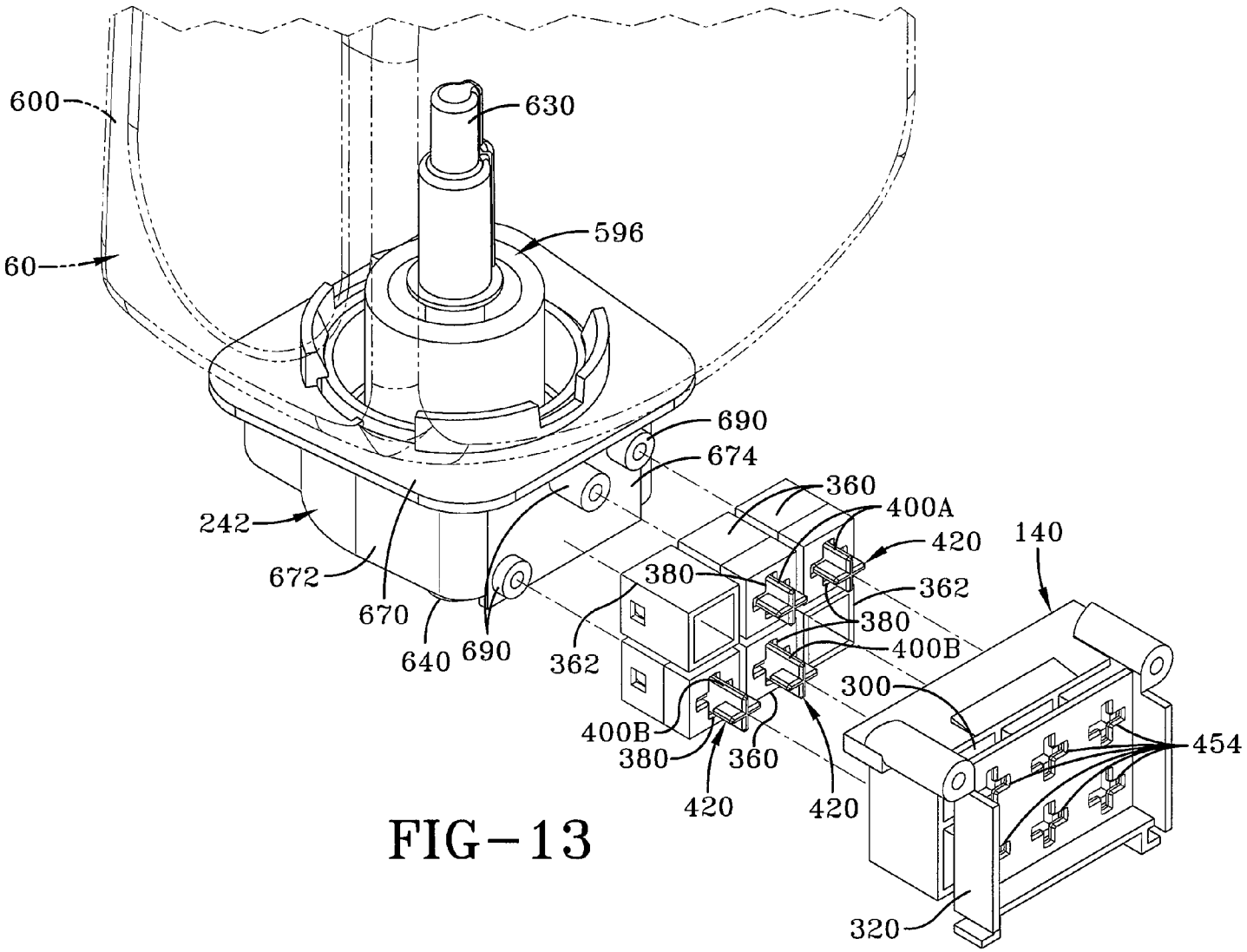
FIG. 13 is a perspective view showing a plurality of markers carried by a collar maintained by the refill container that are interfaced with the lock assembly in accordance with the concepts of the present invention.
Figure 14:
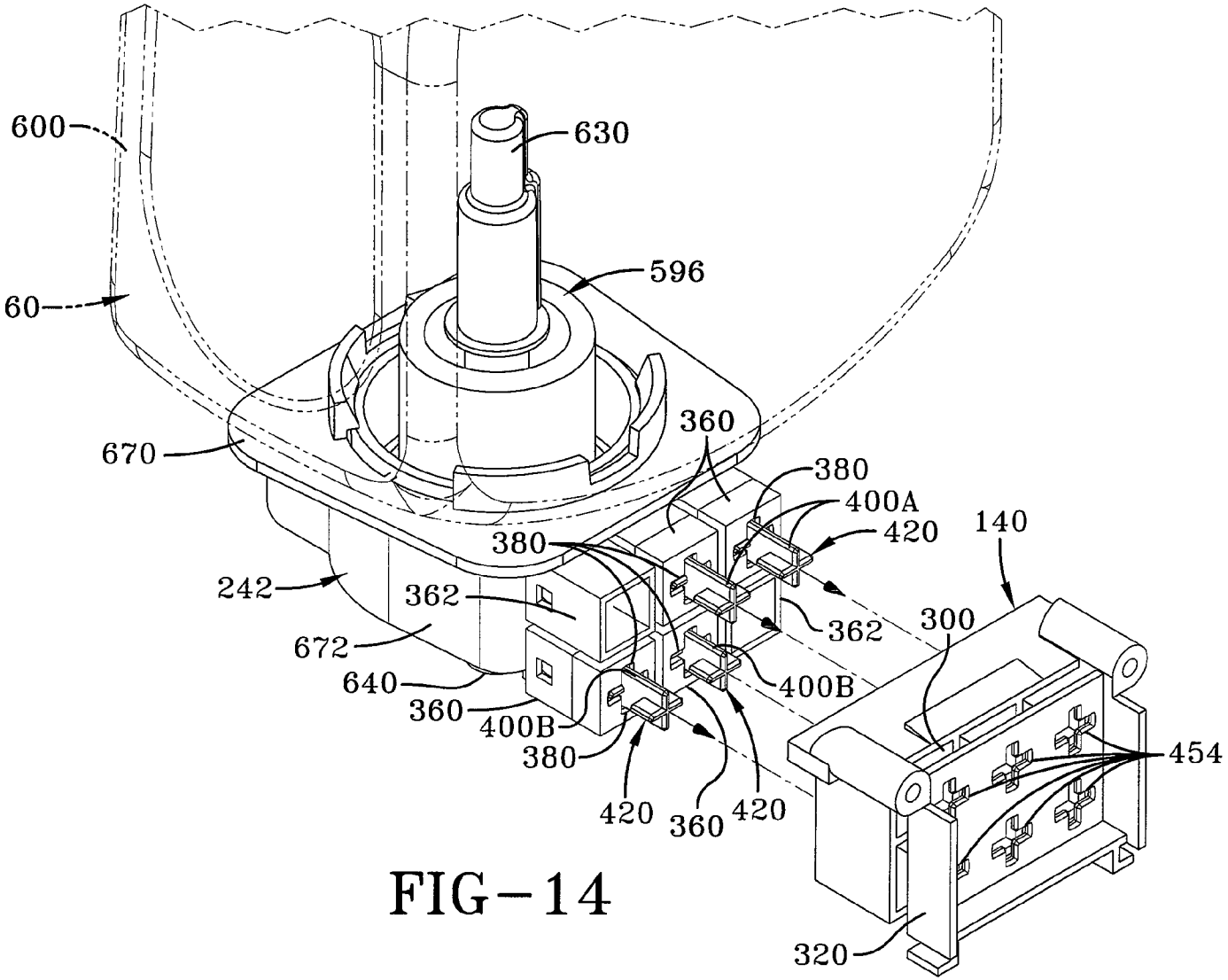
FIG. 14 is a perspective view showing a plurality of plungers maintained by the plunger blocks, as the plungers are biased by the markers in accordance with the concepts of the present invention.

The refill container 60 comprises a collapsible bottle 600 that includes a neck portion 610 that is received within the collar 242, shown clearly in FIGS. 6, 7, 13, and 14. Extending within the neck portion 610 of the bottle 600 of the refill container 60 is a pump 596 that maintains a tube or other conduit 630 at one end in fluid communication with the material within the volume of the bottle 600 and a dispensing nozzle 640 at another end configured to dispense the material when the actuator 50 has been depressed or otherwise engaged. The collar 242 maintains a support section 670 that is shaped and dimensioned to be received within the receiver 240 and supported therein by the lateral support ledges 230 of the support bracket 120. Extending from the support section 670 is a sleeve 672 maintaining an engagement surface 674 that includes an arrangement of markers 690 disposed thereon, as shown in FIG. 13. The markers 690 comprise a protrusion that may be of any desired shape or dimension that are arranged so as to be receivable within the engagement apertures 370 of the plunger blocks 360, so as to engage the contact surface 422 maintained by the head 410 of the plungers 400A and to engage the contact surface 424 disposed within the recessed head 412 of the plungers 400B.

In another aspect, the markers 690 may comprise magnetic material disposed within a protrusion or disposed directly within the engagement surface 674, which allows the markers 690 to magnetically bias the magnetic heads 410,412 of the plungers 400A-B without physically contacting them. For example, the magnetic N (north) or S (south) poles of one or more of the markers 690 may be oriented so that it opposes and repels the magnetic N (north) or S (south) poles of the magnetic material in the heads 410,412 of the associated magnetic plungers 400A-B, causing the plungers 400A-B to be biased from their resting position. As such, the magnetic markers 690 do not need to physically engage the plungers 400A-B, as the magnetic repulsion or attraction between the magnetic poles N (north) or S (south) of the markers 690 and the magnetic poles N (north) and S (south) of the plunger heads 410,412, causes the plungers 400A-B to be biased in a predetermined manner. In one aspect, the magnetic material used by the markers 690 and plungers 400A-B may comprise neodymium, ferromagnetic material, as well as rare earth magnets, which provides enhanced operating life over that of other magnets. In addition, the plunger heads 410,412 may be formed of steel or other magnetically-attracting or repelling material or vice versa. Thus, in such configurations, the steel and magnets form an attraction force therebetween, so as to cause the plungers 400A-B to be attracted to the markers 690.

It should also be appreciated that the key parameter or code may be formed as a data word in which the magnetic characteristics of each marker 690 form a data bit that is defined by the following: data bit "0", which is associated with no magnet; data bit "1", which is associated with magnetic north (N); and data bit "−1", which is associated with magnetic south (S). Thus, the key parameter or code may be formed from any number and/or combination of these data bits 0 (no magnet), 1 (N), −1 (S), to form a unique data word that is physically embodied by the markers 690. For example, the data word 0, 1, −1 may be used to define a key parameter or code that is associated with refill containers 60 that maintain hand sanitizer; the data word 1, 1, −1, 0 may be used to define a key parameter or code that is associated with refill containers 60 that maintain bland soap; and the data word −1, 1, −1 may be used to define a key parameter or code that is associated with refill containers 60 that maintain surgical scrub soap. Thus, by creating unique key parameters or codes from the data bits 0, 1, −1, a wide range of products or material carried by the refill container 60 can be uniquely identified in order to control the use of specific refill containers 60 in specific dispensers 20 that have a complementary or compatible lock characteristic.

Thus, the markers 690 bias the plungers 400A-B by any combination of repulsion or attraction via any combination of magnets, whereby the keyed extension 420 is moved to place the lock section 452 out of the lock slot 560 and to place the notched section 456 in a position to receive the slide slot 550 therethrough, thus unlocking the dispenser. And as a result, the lock arm 540 is permitted to slide upward when the actuator 50 is engaged by the user, allowing material from the refill container 60 to be dispensed therefrom.

In order to limit the operation of the dispenser 10 with only specific refill containers 60, the markers 690 are configured in accordance with a predetermined key parameter, which defines the physical attributes of the markers 690 and enables them to operate as a key with respect to the lock parameter defined by the plungers 400A-B carried by the lock assembly 140. Thus, when the markers 690 are configured with a key parameter that is compatible with the lock parameter established by the lock assembly 140 and its associated components, the engagement bar 160 is transitioned from a locked state to an unlocked state to enable the operation of dispenser 10. As such, the predetermined key parameter may be defined by the arrangement of one or more of the markers 690, the amount that one or more of the markers 690 extends away from the engagement surface 674, the magnetic orientation of the poles (north-south) of one or more of the markers 690, the arrangement of magnetically-attractive material maintained by the plunger heads 410,412 and/or the markers 690, and the shape and/or dimension of one or more of the markers 690.

Moreover, one or more markers 690 may be disposed upon the collar 242 but do not have any active function in biasing the plungers 400A-B. Likewise, one or more plunger blocks 360 may be disposed within the lock assembly 140 but may be configured such that the keyed extension 420 of one or more of the plungers 400A-B maintained thereby does not serve to actually lock the engagement bar 160. Thus, including additional "false" markers 690 and/or "false" plunger blocks 360 further complicates the efforts of an individual when surreptitiously attempting to define the lock or key characteristic in order to circumvent the locking system of the dispenser 10.

To enable a refill container 60 to unlock the dispenser 10 from its initially locked state, so as to dispense material therefrom, the predetermined key parameter of the markers 690 is chosen so that it is complementary to or compatible with that of the lock parameter of the lock assembly 140, so as to be authorized thereby. As such, when the markers 690 engage the plungers 400A-B, via direct physical contact or magnetically, the lock assembly 140 transitions from a locked state to an unlocked state. In other words, to enable the dispenser 20 to be operable with one or more specific refill containers 60, the key parameter associated with the markers 690 of the collar 242 is configured so as to be authorized by the lock parameter associated with the lock assembly 140, such that the plungers 400A-B are biased to transition from a normally locked state to an unlocked state. Once the dispenser 10 is unlocked, the engagement of the actuator 50 causes the engagement bar 160 to move upward and engage the pump 596 to thereby dispense material from the refill container 60. Thus, when the dispenser 10 is assembled, it is configured with a predetermined lock parameter that prevents the dispenser 10 from operating unless the refill container 60 installed therein has a key parameter that is authorized by the lock parameter. Consequently, refill containers 60 that have a key parameter that is not authorized by the lock parameter of the dispenser 10 fail to unlock the dispenser 10, thus preventing the dispensement of material from the refill container 60.

Thus, with the structural components of the dispenser 10 now set forth, the following discussion will present the operational steps taken by the locking dispenser 10 when a refill container 60 having markers 690 configured with a key characteristic to be authorized by the lock parameter of the dispenser 10 is installed therein. To facilitate the understanding of the operation of the dispenser 10 when it transitions from a normally locked state to an unlocked state, reference will be made to FIGS. 15-18. Initially, prior to the refill container 60 being inserted into the dispenser 10, the plungers 400A-B are biased by the springs 460 maintained by the plunger blocks 360 to their normally locked position, as shown in FIG. 15A-15B. As such, the keyed extension 420 is received through the key apertures 542 of the lock arm 540 of the engagement bar 160 and through the lock plate apertures 454 of the lock plate 320, such that the lock section 452 of the keyed extension 420 is received within the lock slots 560 of the lock arm 540, thus locking the actuator arm 160 in place and preventing the depression of the actuator 50 and the dispensing of material from the refill container 60. Although the prior discussion sets forth that each of the plungers 400A-B are normally biased to their locked position prior to the insertion of the refill container 60, other embodiments may exist whereby only a portion of each of the plungers 400A-B are normally biased to their locked position.

Figure 16A:
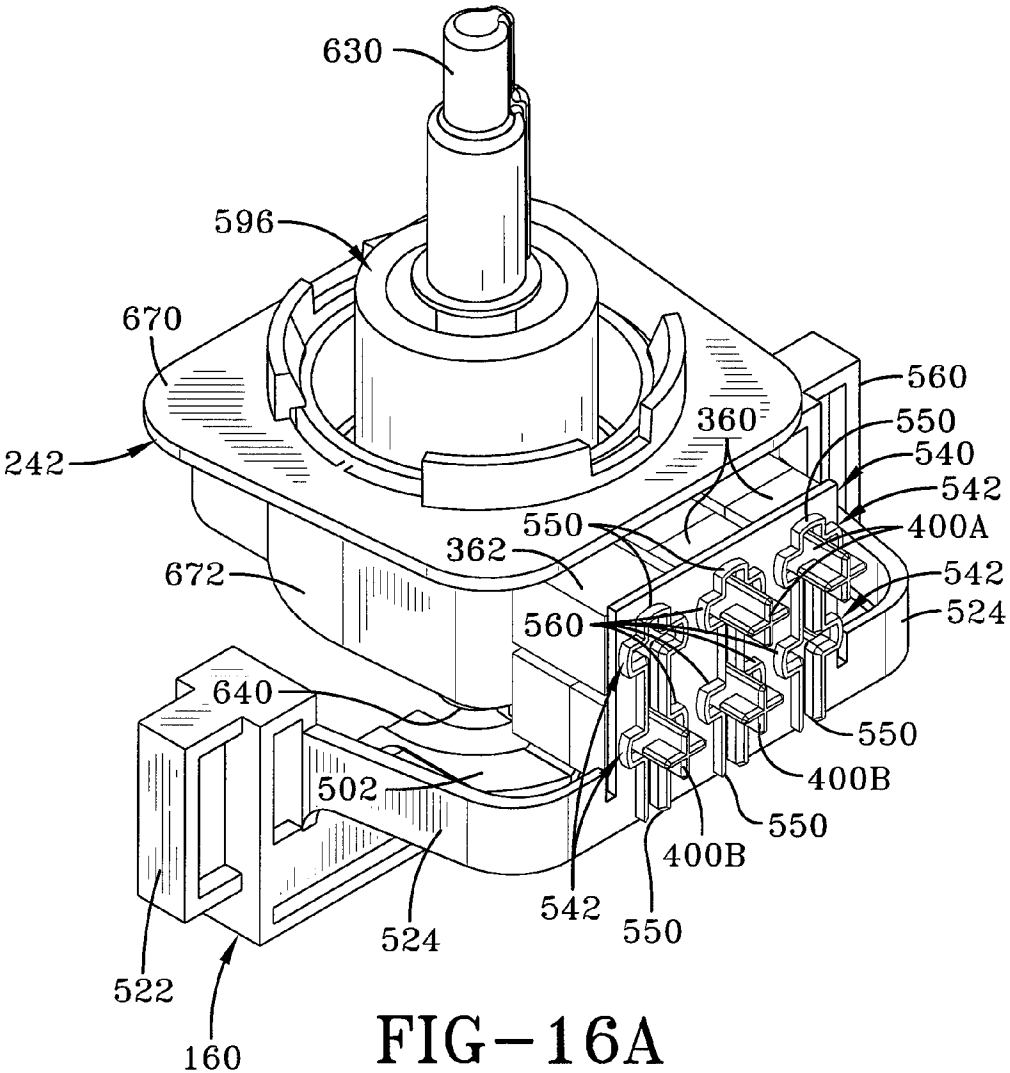
FIG. 16A is a perspective view showing the engagement arm in an unlocked state in accordance with the concepts of the present invention.
Figure 16B:
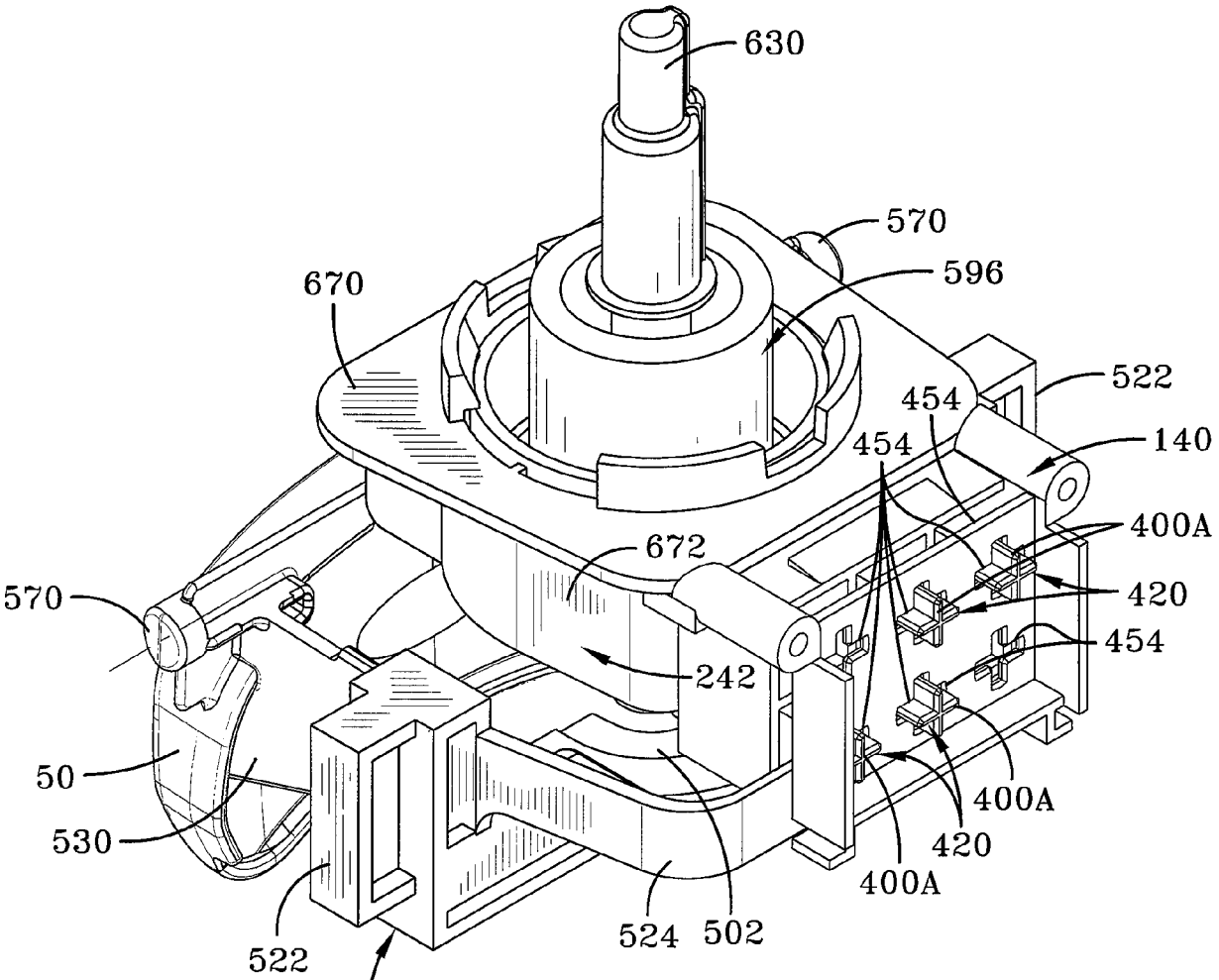
FIG. 16B is a perspective view showing the lock assembly with the engagement bar in an unlocked state in accordance with the concepts of the present invention.

Next, when the refill container 60 is inserted into the dispenser 10, the support section 670 of the collar 242 is placed upon the support ledge 230 and within the receiver 240 so that the markers 690 are interfaced with the plungers 400A-B of the lock assembly 140 via the engagement apertures 370, as shown in FIGS. 16A and 16B. It should be appreciated that the interface between the contact surface 422,424 of plungers 400A-B and the markers 690 used to bias the plungers 400A-B may be achieved via physical contact, magnetic interaction (attraction or repulsion), or any other suitable means of interaction, as previously discussed.

Figure 17B:
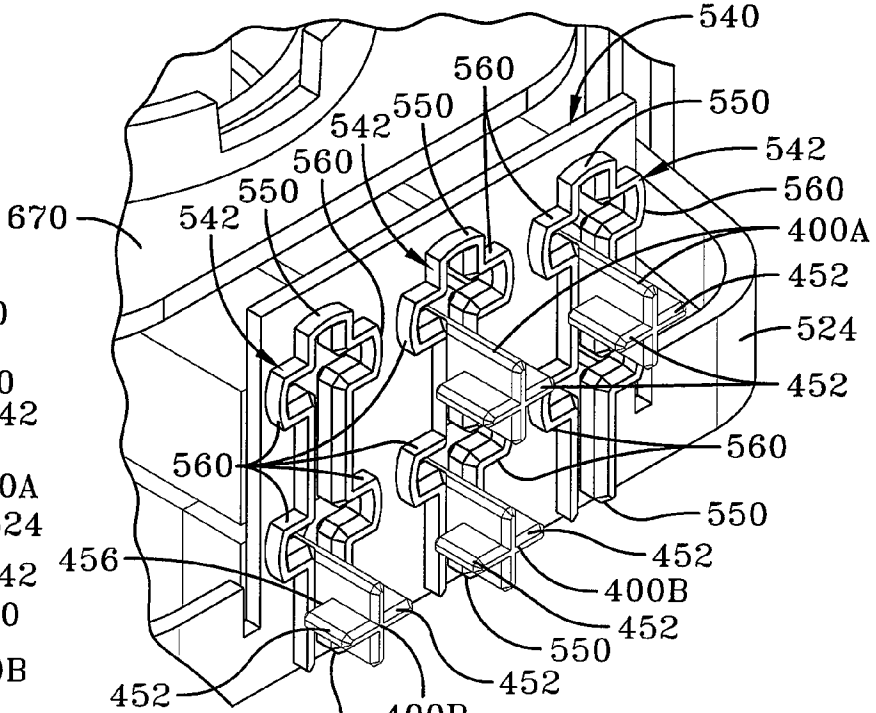
FIG. 17B is another perspective view of the engagement bar showing the movement of the engagement bar in the upward direction in accordance with the concepts of the present invention.
Figure 17A:
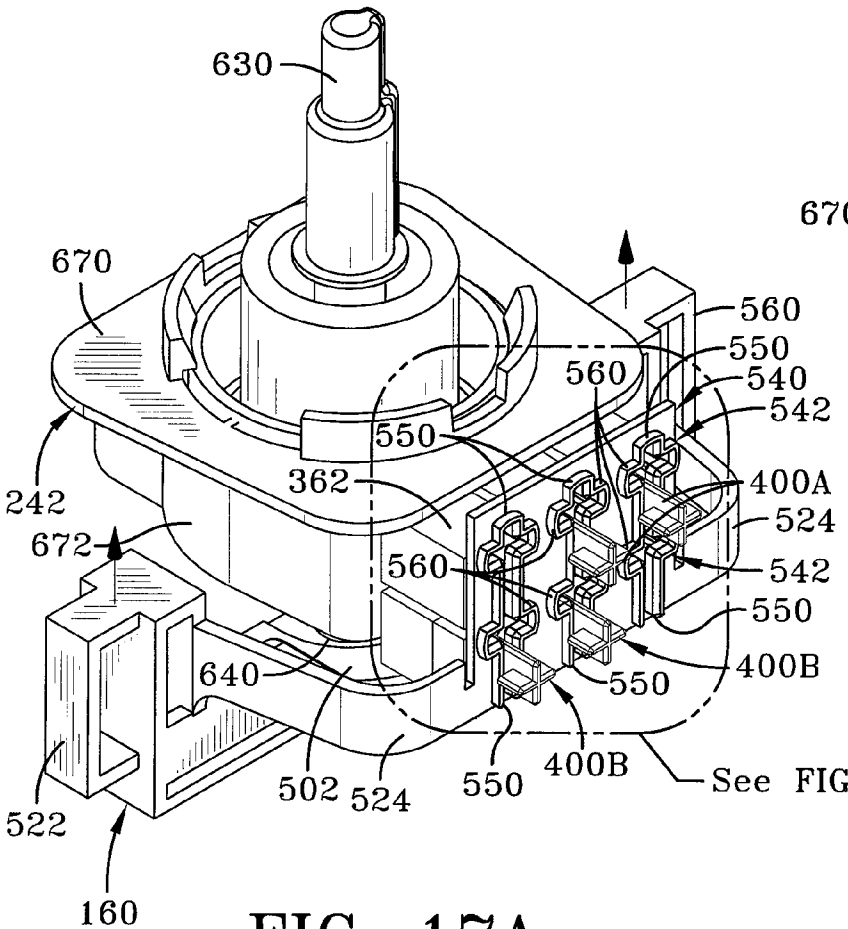
FIG. 17A is a perspective view of the engagement bar when the plungers are in an unlocked state and moved in an upward direction in accordance with the concepts of the present invention.
Figure 17C:
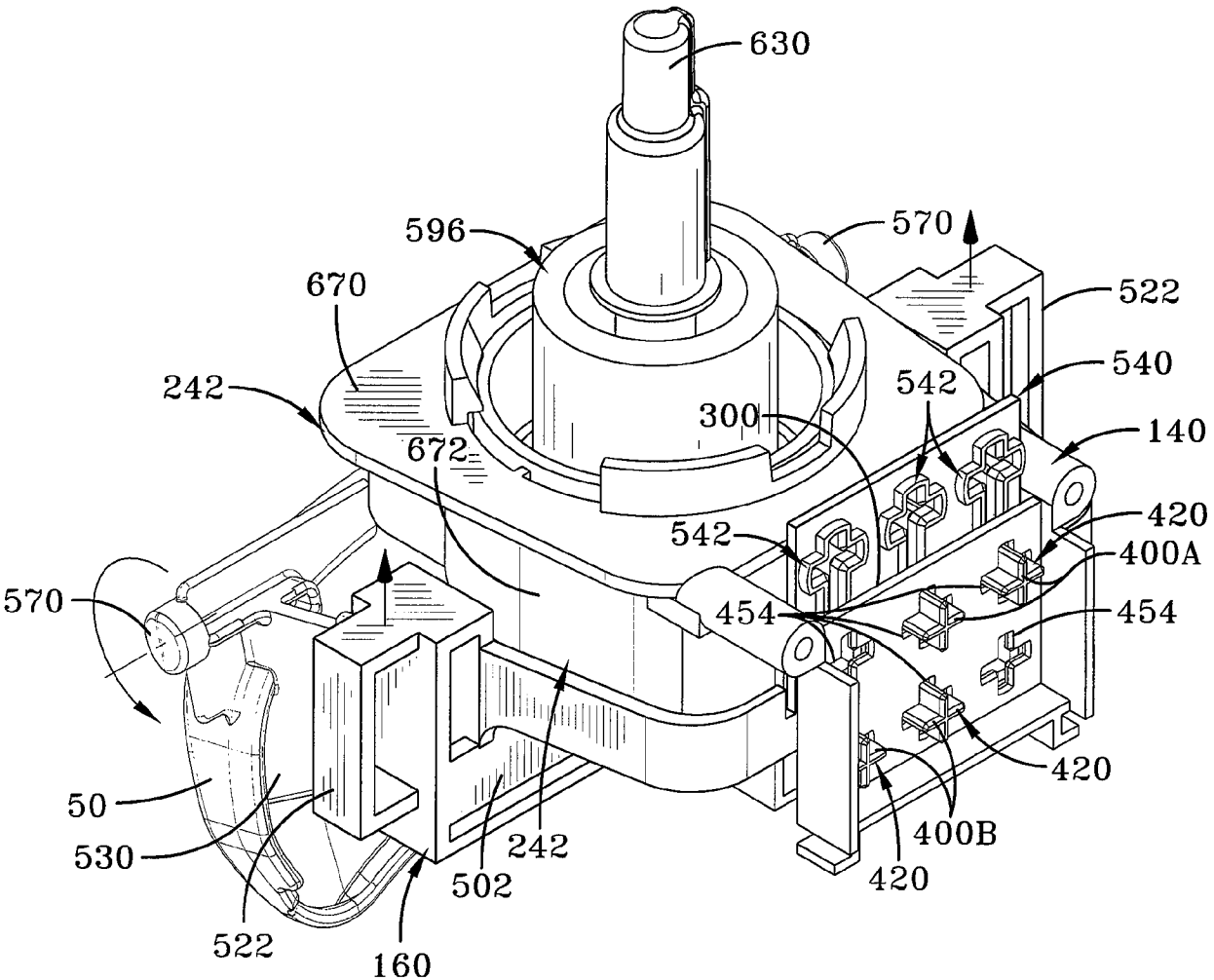
FIG. 17C is a perspective view showing the upward movement of the lock arm maintained by the engagement bar within the lock assembly in accordance with the concepts of the present invention.

Once the markers 690 of the collar 242 and the plungers 400A-B of the lock assembly 140 are interfaced, the markers 690 bias the plungers 400A-B against the spring 460 in accordance with their predetermined key parameter. That is, the markers 690 bias the plungers 400A-B to the extent established by the predetermined key parameter that defines the physical attributes of the markers 690, including, but not limited to, their length, size, shape, magnetic orientation of the (N) north and (S) south poles, their relative arrangement, their shape, and the like. If the key parameter of the markers 690 biases the plungers 400A-B in a manner complementary to their lock parameter, then the lock section 452 of the keyed extension 420 is moved out of the lock slot of the locking apertures 542, and the notched section 456 of the keyed extension 420 is moved so that it is within the slide slot 550 of the lock arm 540, as shown in FIG. 16A. As such, when the actuator 50 is engaged by the user, the engagement bar 160 is allowed to slide upward within the key slot 300 of the lock assembly 140, as shown in FIGS. 17A-C, so as to engage the pump 596, causing material from the refill container 60 to be dispensed therefrom. However, if the key parameter of the markers 690 is not complementary to the lock parameter of the lock assembly 140 and its components so as not to be authorized, then one or more of the plungers 400A-B are not properly biased, and, as such, the dispenser 10 will remain in its locked state, whereby the lock sections 452 of one or more of the keyed extension 420 remains within respective lock slots 560 of the lock arm 540, thus preventing the engagement bar 160 from sliding upward to actuate the pump 596 when the actuator 50 is depressed.

Thus, an entity that provides the locking dispenser 10 to a business, hospital, or other institution is able to control which specific refill containers 60 are operable with the dispenser. As such, the inadvertent installation of a refill container 60 that contains inappropriate material for a given application is prevented, such as the inadvertent substitution of regular soap for antibacterial soap. Furthermore, the locking dispenser 10 prevents individuals intending to harm others by the installation of a tainted refill container 60 into the dispenser 10, from being able to readily identify the physical characteristics of the markers 690 that form the key parameter needed to operate the dispenser 10.

It will, therefore, be appreciated that one advantage of one or more embodiments of the present invention is that a locking dispenser provides a refill container with a key parameter and a lock assembly having a lock parameter, which enables the operation of the dispenser when the key parameter is authorized by the lock parameter. Another advantage of the present invention is that the locking dispenser prevents the use of incompatible refill containers without utilizing complex electronic components. Still another advantage of the present invention is that the locking dispenser utilizes components that are resistant to corrosion from moisture. Yet another advantage of the present invention is that the lock parameter can be readily modified, and the key parameter can be readily modified to enable the dispensers to be operable with only a select group of refill containers. An additional advantage of the present invention is that the lock parameter and the key parameter of the lock assembly and the refill container may be embodied by magnetic attraction and/or repulsion.

Although the present invention has been described in considerable detail with reference to certain embodiments, other embodiments are possible. Therefore, the spirit and scope of the appended claims should not be limited to the description of the embodiments contained herein.

What is claimed is:

1. A locking dispenser comprising:

a refill container carrying material therein to be dispensed by a pump coupled thereto, said refill container having a collar maintaining at least one marker configured in accordance with a predetermined key parameter;

a support bracket adapted to carry said refill container;

a lock assembly attached to said support bracket configured to be interfaced with said collar, said lock assembly maintaining at least one movable plunger configured in accordance with a predetermined lock parameter; and an engagement bar operatively coupled to said support bracket that when actuated engages said pump to dispense said material from said refill container, said engagement bar maintaining a lock arm in operative communication with said at least one plunger, said plunger initially locking said lock arm to prevent the actuation of said engagement bar;

wherein said plunger unlocks said lock arm to enable the actuation of said engagement bar if said key parameter of said at least one marker is authorized by said lock parameter of said plunger when said marker and said plunger are interfaced, so as to enable the dispensing of said material from said refill container when said engagement bar is actuated.

2. The locking dispenser of claim 1, wherein said at least one marker and said at least one plunger comprise magnets configured in accordance with said respective key parameter and said lock parameter.

3. The locking dispenser of claim 2, wherein said magnets are enclosed in plastic.

4. The locking dispenser of claim 2, wherein said lock parameter is defined at least partially by the orientation of said magnetic poles of said magnet maintained by said plunger.

5. The locking dispenser of claim 2, wherein said key parameter is defined at least partially by the orientation of said magnetic poles of said magnet maintained by said marker.

6. The locking dispenser of claim 1, wherein said lock parameter is defined at least partially by the arrangement of said plungers.

7. The locking dispenser of claim 1, wherein said key parameter is defined at least partially by the arrangement of said markers.

8. The locking dispenser of claim 1, wherein said lock arm maintains at least one locking aperture through which said at least one plunger extends.

9. The locking dispenser of claim 8, wherein said at least one plunger comprises a head from which extends a keyed extension having a lock section and a notched section, wherein said keyed extension is received through said locking aperture.

10. The locking dispenser of claim 9, wherein when said lock arm is locked, said lock section of said at least one plunger is received within said locking aperture of said lock arm.

11. The locking dispenser of claim 9, wherein when said lock arm is unlocked, said notched section of said at least one plunger is received within said locking aperture of said lock arm.

12. The locking dispenser of claim 11, wherein said locking aperture comprises a slide slot that extends at least partially to an edge of said lock arm, such that when said lock arm is unlocked, said plunger is received within said slide slot, allowing said engagement arm to freely slide about said slide slot.

13. The locking dispenser of claim 9, wherein said plunger head is recessed to receive said at least one marker.

14. The locking dispenser of claim 9, wherein said lock assembly maintains a lock slot that separates a lock plate from a lock grid that maintains said at least one plunger, wherein said lock slot receives said lock arm.

15. The locking dispenser of claim 14, wherein said lock plate maintains at least one aperture to receive said keyed extension.

16. The locking dispenser of claim 1, wherein said key parameter is defined by the arrangement of at least one magnetic north marker, at least one magnetic south marker, and at least one non-magnetic marker.

17. A method for operating a locking dispenser comprising:

providing a dispenser maintaining at least one movable plunger configured in accordance with a lock parameter, said plunger operatively engaging said dispenser to place said dispenser in a normally locked state;

providing a refill container carrying material to be dispensed having at least one marker configured in accordance with a key parameter;

installing said refill container at said dispenser, such that said marker is interfaced with said plunger;

unlocking said dispenser if said key parameter of said marker is authorized by said lock parameter of said plunger;

actuating said dispenser to dispense said material from said refill container and locking said dispenser when said refill container is uninstalled from said dispenser.

18. A method for operating a locking dispenser comprising:

providing a dispenser maintaining at least one movable plunger configured in accordance with a lock parameter, said plunger operatively engaging said dispenser to place said dispenser in a normally locked state;

providing a refill container carrying material to be dispensed having at least one marker configured in accordance with a key parameter, wherein said key parameter of said at least one marker is at least partially defined by a magnet;

installing said refill container at said dispenser, such that said marker is interfaced with said plunger; and unlocking said dispenser if said key parameter of said marker is authorized by said lock parameter of said plunger.

19. A method for operating a locking dispenser comprising:

providing a dispenser maintaining at least one movable plunger configured in accordance with a lock parameter, wherein said lock parameter of said at least one said plunger is at least partially defined by a magnet, said plunger operatively engaging said dispenser to place said dispenser in a normally locked state; providing a refill container carrying material to be dispensed having at least one marker configured in accordance with a key parameter;

installing said refill container at said dispenser, such that said marker is interfaced with said plunger; and unlocking said dispenser if said key parameter of said marker is authorized by said lock parameter of said plunger.

20. A method for operating a locking dispenser comprising:

providing a dispenser maintaining at least one movable plunger configured in accordance with a lock parameter, said plunger operatively engaging said dispenser to place said dispenser in a normally locked state;

providing a refill container carrying material to be dispensed having at least one marker configured in accordance with a key parameter, wherein said key parameter of said at least one marker is defined by the arrangement of at least one magnetic north marker, at least one magnetic south marker, and at least one non-magnetic marker;

installing said refill container at said dispenser, such that said marker is interfaced with said plunger; and unlocking said dispenser if said key parameter of said marker is authorized by said lock parameter of said plunger.

21. A locking dispenser for dispensing material from a pump fluidly coupled to a replaceable refill container, the replaceable refill container having at least one marker configured with a predetermined key parameter, the locking dispenser comprising:

a support bracket adapted to carry the replaceable refill container;

a lock assembly attached to said support bracket configured to be interfaced with the marker of the replaceable refill container, said lock assembly maintaining at least one movable plunger configured in accordance with a predetermined lock parameter; and an engagement bar operatively coupled to said support bracket that when actuated engages the pump to dispense the material from the replaceable refill container, said engagement bar maintaining a lock arm in operative communication with said at least one plunger, said plunger initially locking said lock arm to prevent the actuation of said engagement bar;

wherein said plunger unlocks said lock arm to enable the actuation of said engagement bar if the key parameter of the at least one marker is authorized by said lock parameter of said plunger when the marker and said plunger are interfaced, so as to enable the dispensing of the material from the replaceable refill container when said engagement bar is actuated.

22. The locking dispenser of claim 21, wherein said at least one plunger comprises a magnet configured in accordance with said lock parameter.

23. The locking dispenser of claim 22, wherein said magnet is enclosed in plastic.

24. The locking dispenser of claim 22, wherein said lock parameter is defined at least partially by the orientation of said magnetic poles of said magnet.

25. The locking dispenser of claim 21, wherein said lock parameter is defined at least partially by the arrangement of said plungers.

26. The locking dispenser of claim 21, wherein said lock arm maintains at least one locking aperture through which said at least one plunger extends.

27. The locking dispenser of claim 26, wherein said at least one plunger comprises a head from which extends a keyed extension having a lock section and a notched section, wherein said keyed extension is received through said locking aperture.

28. The locking dispenser of claim 27, wherein when said lock arm is locked, said lock section of said at least one plunger is received within said locking aperture of said lock arm.

29. The locking dispenser of claim 27, wherein when said lock arm is unlocked, said notched section of said at least one plunger is received within said locking aperture of said lock arm.

30. The locking dispenser of claim 29, wherein said locking aperture comprises a slide slot that extends at least partially to an edge of said lock arm, such that when said lock arm is unlocked, said plunger is received within said slide slot, allowing said engagement arm to freely slide about said slide slot.

31. The locking dispenser of claim 27, wherein said plunger head is recessed to receive the at least one marker.

32. The locking dispenser of claim 27, wherein said lock assembly maintains a lock slot that separates a lock plate from a lock grid that maintains said at least one plunger, wherein said lock slot receives said lock arm.

33. The locking dispenser of claim 32, wherein said lock plate maintains at least one aperture to receive said keyed extension.

* * * * *